US012305906B2

(12) United States Patent
Hodnett et al.

(10) Patent No.: US 12,305,906 B2
(45) Date of Patent: May 20, 2025

(54) AIR COOLING ASSEMBLY FOR A COOLING DEVICE

(71) Applicant: Electrolux Home Products, Inc., Charlotte, NC (US)

(72) Inventors: Kelly Hodnett, Piedmont, SC (US); Julio Battirola, Anderson, SC (US); Scott Richardson, Simpsonville, SC (US); Marco Francescon, Anderson, SC (US); Patrick Keller, Anderson, SC (US); Michel V. Werkhauser, Anderson, SC (US); Leandro Pizzatto, Anderson, SC (US); Kalyanasundaram Venketraj, Anderson, SC (US)

(73) Assignee: Electrolux Consumer Products, Inc., Charlotte, NC (US)

( * ) Notice: Subject to any disclaimer, the term of this patent is extended or adjusted under 35 U.S.C. 154(b) by 160 days.

(21) Appl. No.: 18/065,926

(22) Filed: Dec. 14, 2022

(65) Prior Publication Data

US 2024/0200847 A1 Jun. 20, 2024

(51) Int. Cl.
*F25D 17/04* (2006.01)
*F25D 11/02* (2006.01)
*F25D 17/06* (2006.01)

(52) U.S. Cl.
CPC ..... *F25D 17/045* (2013.01); *F25D 11/02* (2013.01); *F25D 17/065* (2013.01); *F25D 2317/0681* (2013.01)

(58) Field of Classification Search
CPC .... F25D 17/045; F25D 17/065; F25D 17/067; F25D 11/02; F25D 2317/0681;
(Continued)

(56) References Cited

U.S. PATENT DOCUMENTS 7,032,407 B2 4/2006 Chastine
8,074,469 B2 12/2011 Hamel et al.
(Continued)

FOREIGN PATENT DOCUMENTS

CN 111947368 A * 11/2020 ..... F25D 11/00
JP 2019132467 A * 8/2019 ..... F25C 1/24
(Continued)

OTHER PUBLICATIONS

Lack of Unity of Invention and Invitation to Pay Additional Fees for PCT/US2023/083091, dated Apr. 8, 2024, 12 pages.
(Continued)

*Primary Examiner* — Emmanuel E Duke
(74) *Attorney, Agent, or Firm* — Chrisman Gallo Tochtrop LLC

(57) ABSTRACT

A cooling device including a first storage compartment and a second storage compartment disposed adjacent to the first storage compartment. An evaporator is disposed adjacent a wall of the second storage compartment. An air distributor assembly is disposed within the second storage compartment such that the evaporator is positioned between the air distributor assembly and the wall. The air distributor assembly includes an air plenum and a first flow path defined therein. A first damper is disposed within the air distributor assembly. The first damper is movable between first and second positions. When the first damper is in the first position, a first portion of airflow received in the air plenum is permitted to flow into the first flow path. When the first damper is in the second position, the first portion of the airflow is hindered from flowing into the first flow path.

20 Claims, 10 Drawing Sheets

(58) Field of Classification Search
CPC ..... F25D 2317/0666; F25D 2317/0683; F25D 21/14; F25D 2400/16
See application file for complete search history.

(56) References Cited

U.S. PATENT DOCUMENTS

| | | | |
|---|---|---|---|
| 8,196,427 | B2 | 6/2012 | Bae et al. |
| 8,806,885 | B2 | 8/2014 | Bae et al. |
| 8,904,817 | B2 | 12/2014 | Kim et al. |
| 8,950,209 | B2 | 2/2015 | Junge et al. |
| 9,140,472 | B2 | 9/2015 | Shin et al. |
| 9,382,909 | B2 | 7/2016 | Hwang |
| 10,088,218 | B2 | 10/2018 | Hu et al. |
| 10,274,242 | B2 | 4/2019 | Besore et al. |
| 10,281,190 | B2 | 5/2019 | Besore et al. |
| 10,288,340 | B2 | 5/2019 | Besore et al. |
| 10,465,967 | B2 | 11/2019 | Besore et al. |
| 10,718,562 | B2 | 7/2020 | Kim et al. |
| 10,969,157 | B2 | 4/2021 | Cheng et al. |
| 11,047,607 | B2 | 6/2021 | Kim et al. |
| 11,150,006 | B2 | 10/2021 | Guanye et al. |
| 2010/0162747 | A1* | 7/2010 | Hamel ..... F25D 17/065 62/455 |
| 2013/0042641 | A1 | 2/2013 | Ryu et al. |
| 2019/0376736 | A1 | 12/2019 | Kawasaki et al. |
| 2020/0116418 | A1* | 4/2020 | Brooke ..... F25D 17/045 |
| 2020/0300533 | A1 | 9/2020 | Kim et al. |
| 2021/0172668 | A1* | 6/2021 | Park ..... F25D 11/02 |
| 2022/0341648 | A1 | 10/2022 | Pagnozzi et al. |

FOREIGN PATENT DOCUMENTS

| | | | |
|---|---|---|---|
| KR | 102176725 | 11/2020 | |
| WO | WO-2010099101 A2 * | 9/2010 | ..... F25B 29/00 |
| WO | WO-2021180440 A1 * | 9/2021 | ..... F25D 17/062 |

OTHER PUBLICATIONS

International Search Report for PCT/US2023/083091, dated Jul. 16, 2024, 22 pages.

* cited by examiner

AIR COOLING ASSEMBLY FOR A COOLING DEVICE

FIELD OF THE INVENTION

This application relates generally to an air cooling assembly for a cooling device, and more particularly, an air cooling assembly for cooling a dedicated upper, fresh-food compartment and a lower, convertible compartment, wherein the upper and lower compartments are cooled via a common evaporator.

BACKGROUND OF THE INVENTION

Conventional cooling devices, such as domestic refrigerators/freezers, typically have multiple storage compartments therein. Generally, one storage compartment is configured to function as a dedicated fresh food compartment, and another storage compartment is configured to function as a dedicated freezer compartment. It is also known for a storage compartment to be convertible so as to function as either a fresh food compartment or a freezer compartment.

Notably, in cooling devices having a 'dedicated' storage compartment and a 'convertible' storage compartment, the appliance generally includes two, distinct evaporators; one for each of said compartments. More specifically, one evaporator is provided for supplying cool air to the 'dedicated' storage compartment, and another, separate evaporator is provided for supplying cool air to the 'convertible' compartment. While such dual-evaporator systems permit sufficient cooling for the 'dedicated' and 'convertible' storage compartments, such systems increase cost and complexity of the overall appliance and require sufficient space within the appliance to house the separate evaporators.

BRIEF SUMMARY OF THE INVENTION

In accordance with one aspect, a cooling device is provided and includes a first storage compartment and a second storage compartment disposed adjacent to the first storage compartment. An evaporator is disposed adjacent a wall of the second storage compartment, and an air distributor assembly is disposed within the second storage compartment such that the evaporator is positioned between the air distributor assembly and the wall. The air distributor assembly includes an air plenum and a first flow path defined therein. A fan is positioned within the air plenum and is configured to draw an airflow over the evaporator and into the air plenum. A first damper is disposed within the air distributor assembly and fluidly between the air plenum and the first flow path. The first damper is movable between a first position and a second position. When the first damper is in the first position, a first portion of the airflow received in the air plenum is permitted to flow into the first flow path. When the first damper is in the second position, the first portion of the airflow is hindered from flowing into the first flow path.

In accordance with another aspect, there is provided a cooling device including a dedicated fresh food compartment and a convertible compartment disposed vertically below the dedicated fresh food compartment. The cooling device further includes an evaporator common to said dedicated fresh food compartment and said convertible compartment, wherein only said evaporator provides a cooling effect to each of the dedicated fresh food compartment and the convertible compartment. The evaporator is disposed adjacent a rear wall of the convertible compartment. An air distributor assembly is disposed within the convertible compartment such that the evaporator is positioned between the air distributor assembly and the rear wall. The air distributor assembly includes a body having an air plenum and a duct that is formed as a recess in a surface of the body. A planar panel is disposed adjacent the surface of the body so as to cover the duct to define a first flow path therein. A fan is positioned within the air plenum and is configured to draw an airflow over the evaporator and into the air plenum.

A first damper is disposed within the air distributor assembly and is fluidly between the air plenum and the first flow path. The first damper is movable between a first position and a second position. When the first damper is in the first position, a first portion of the airflow received in the air plenum is permitted to flow into the first flow path and into the convertible compartment. When the first damper is in the second position, the first portion of the airflow is hindered from flowing into the first flow path and into the convertible compartment. An air tower is disposed within the dedicated fresh food compartment. The air tower defines a second flow path therein, wherein the second flow path is in fluid communication with the air plenum. A second damper is provided in the second flow path. The second damper is configured to selectively permit or hinder a second portion of the airflow received in the air plenum to flow through the second flow path and into the dedicated fresh food compartment.

DESCRIPTION OF EXAMPLE EMBODIMENTS

Figure 1:
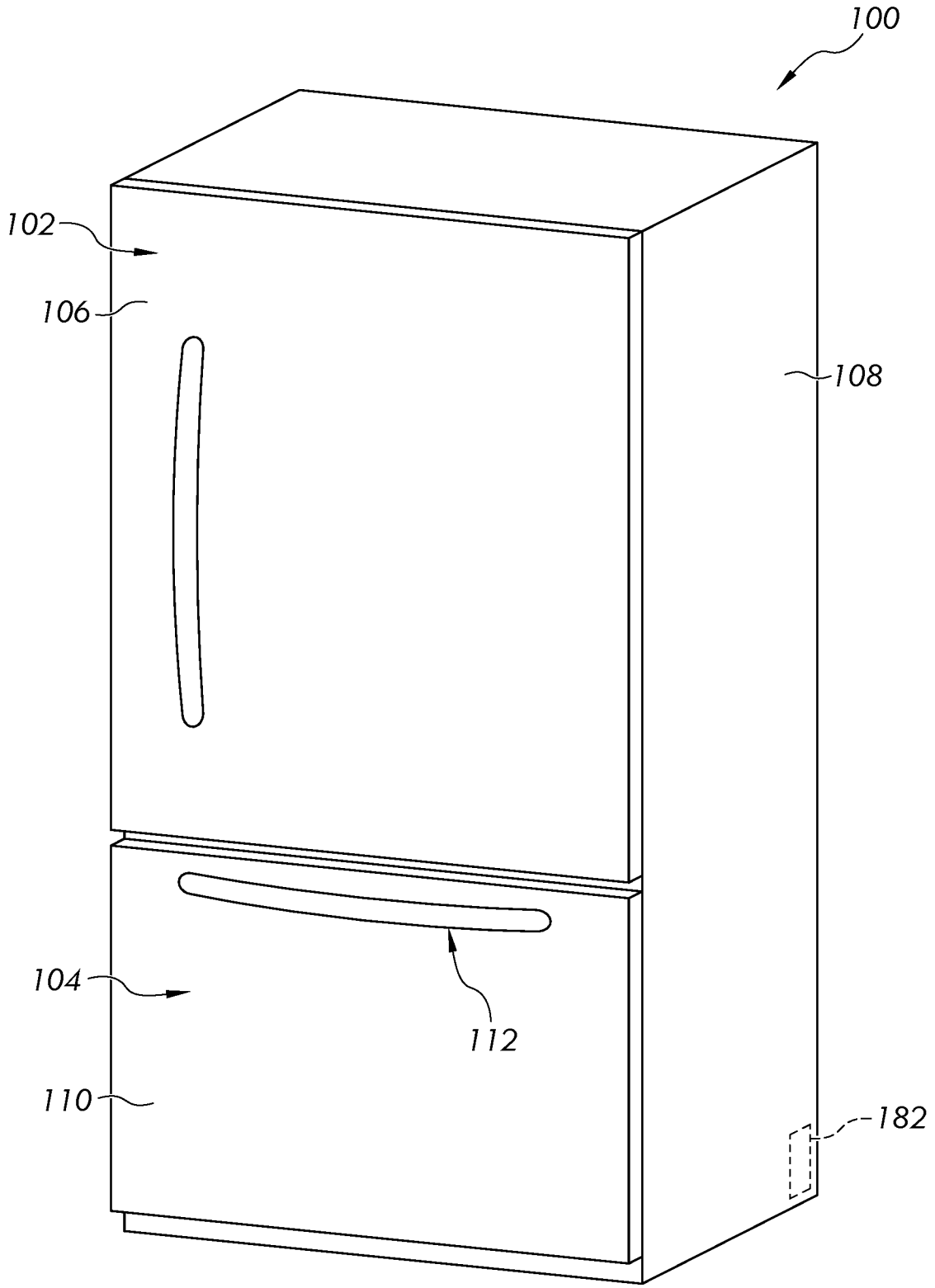
FIG. 1 is a front perspective view of a cooling device.

Referring now to the drawings, FIG. 1 shows a cooling device, which may include various types of refrigeration appliances in the form of a domestic refrigerator and/or a domestic freezer, indicated generally at 100. Although the detailed description that follows concerns a domestic refrigerator 100, the invention can be embodied by refrigeration appliances other than a domestic refrigerator 100. Further, an embodiment is described in detail below and shown in the figures as a bottom-mount refrigerator 100, including a first storage compartment disposed vertically above a second storage compartment. As will be further discussed below, the first storage compartment is configured as a dedicated fresh food compartment 102 (i.e., only configured to function as a fresh food compartment), and the second storage compartment is configured as a convertible compartment 104 (i.e., selectively functioning as either a freezer compartment or a fresh food compartment). It is to be understood that other configurations are contemplated, for example, a top-mount refrigerator (i.e., dedicated fresh food compartment 102 disposed vertically below the convertible compartment 104), a side-by-side refrigerator (i.e., dedicated fresh food compartment 102 disposed laterally adjacent the convertible compartment 104), refrigerators including additional variable climate zone compartments, etc.

One or more upper doors 106 are pivotally coupled to a cabinet 108 of the refrigerator 100 to restrict and grant access to the fresh food compartment 102. Notably, the upper door(s) 106 can include a single door that spans the entire lateral distance across the entrance of the fresh food compartment 102 (e.g., as shown in FIG. 1), or can include a pair of French-type doors, that collectively span the entire lateral distance of the entrance of the fresh food compartment 102 to enclose the fresh food compartment 102.

As further shown, the convertible compartment 104 is arranged vertically beneath the fresh food compartment 102. A lower door 110 is provided to restrict and grant access to the convertible compartment 104. In one example, the lower door 110 can be pivotally coupled to the cabinet 108 (in a similar manner to the upper door(s) 106) to restrict/grant access to a storage area within the convertible compartment 104. In another example, a drawer assembly (not shown) including one or more baskets (not shown) can be withdrawn from the convertible compartment 104 to grant a user access to food items stored in the convertible compartment 104. The drawer assembly can be coupled to the lower door 110, which includes a handle 112. When a user grasps the handle 112 and pulls the lower door 110 open, at least one or more of the baskets is caused to be at least partially withdrawn from the convertible compartment 104.

Figure 2:
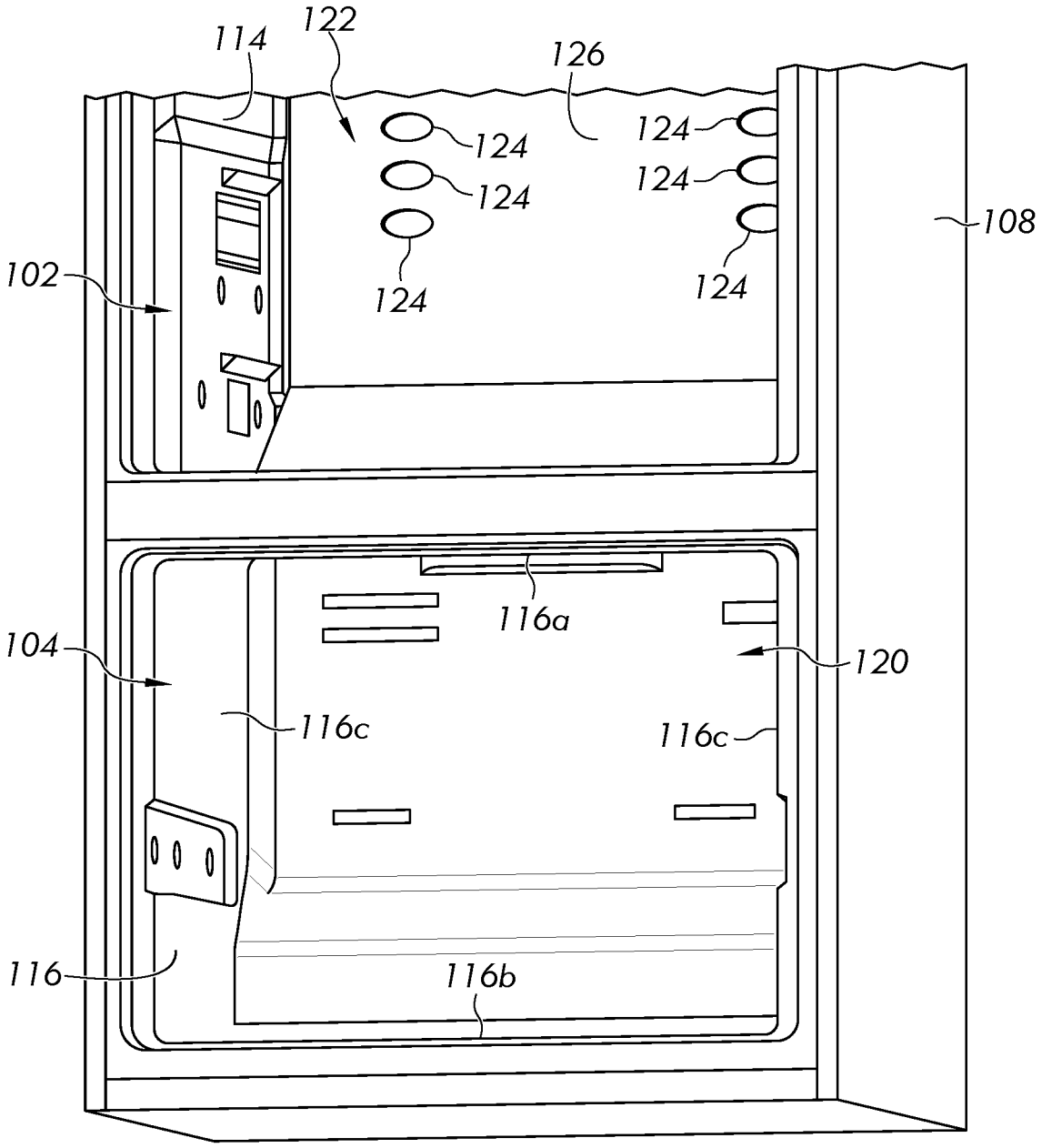
FIG. 2 is a partial, front perspective view of the cooling device in FIG. 1 with doors thereof removed.

Moving on to FIG. 2, the refrigerator 100 further includes an interior liner comprising a fresh food compartment liner 114 and a convertible compartment liner 116 which define the fresh food and convertible compartments 102, 104, respectively. The fresh food compartment 102 is located in the upper portion of the refrigerator 100 in this example and serves to minimize spoiling of articles of food stored therein. The fresh food compartment 102 accomplishes this by maintaining the temperature in the fresh food compartment 102 at a cool temperature that is typically above 0° C., so as not to freeze the articles of food in the fresh food compartment 102. It is contemplated that the cool temperature preferably is between 0° C. and 10° C., more preferably between 0° C. and 5° C., and even more preferably between 0.25° C. and 4.5° C. As mentioned above, the (upper) fresh food compartment 102 in this example is a dedicated fresh food compartment 102. In other words, the fresh food compartment 102 is configured to function only as a fresh food compartment (i.e., within the above-noted temperature ranges), and does not function as a freezer compartment at any point in time during normal use thereof.

The convertible compartment 104 can function as either a fresh food or a freezer compartment, based on a desired user selection. When selected to function as a freezer compartment, the convertible compartment 104 is used to freeze and/or maintain articles of food stored therein in a frozen condition. For this purpose, the convertible compartment 104 is in thermal communication with an evaporator 118 (depicted in FIG. 3, discussed below) that removes thermal energy from the convertible compartment 104 to maintain the temperature therein at a temperature of 0° C. or less during operation of the refrigerator 100, preferably between 0° C. and −50° C., more preferably between 0° C. and −30° C., and even more preferably between 0° C. and −20° C. Separately, when selected to function as a fresh food compartment, the convertible compartment 104 is configured to maintain the temperature therein at a cool temperature, typically above 0° C. so as not to freeze the articles of food therein.

As noted above, the refrigerator 100 discussed herein is depicted as a bottom-mount configuration, wherein the dedicated fresh food compartment 102 is disposed vertically above the convertible compartment 104. That is, in this example, the refrigerator 100 includes only two compartments, wherein the bottom-most compartment is the convertible compartment 104. With this said, it is to be understood that the air cooling assembly described herein can likewise be employed in refrigerators having more than two storage compartments (e.g., three, vertically stacked storage compartments). In such an example, at least the bottom-most compartment is a convertible compartment as discussed herein.

As mentioned above, the fresh food compartment 102 and the convertible compartment 104 are defined by fresh food and convertible compartment liners, 114, 116, respectively. The fresh food and convertible compartment liners 114, 116 may be separate and distinct elements with respect to one another. Alternatively, the fresh food and convertible compartment liners 114, 116 may be integral with respect to one another, with a horizontal mullion disposed therein to separately define the fresh food and convertible compartments 102, 104.

Figure 3:
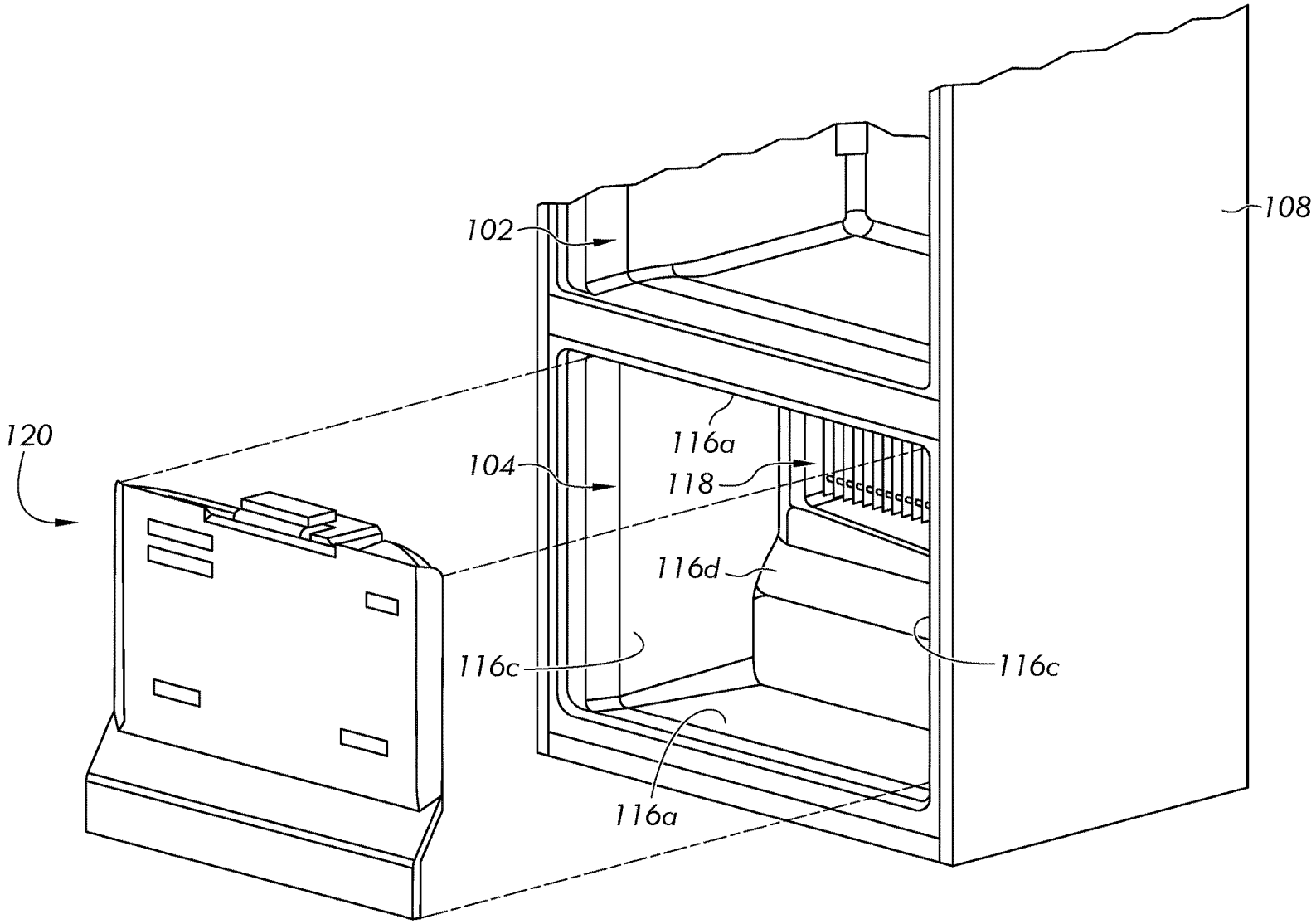
FIG. 3 is a partial, front perspective view of the cooling device in FIG. 1 depicting an air distributor assembly removed from a lower compartment.

The convertible compartment liner 116 includes a top wall 116*a*, a bottom wall 116*b*, a pair of opposing sidewalls 116*c*, and a rear wall 116*d* (shown in FIG. 3). As shown in FIG. 3, an evaporator 118 is disposed adjacent the rear wall 116*d*. As briefly mentioned above, the evaporator 118 is configured to remove thermal energy from the convertible compartment 104 to maintain the temperature therein at a desired temperature range (i.e., to function as either a fresh food or freezer compartment, as will be discussed further below). Notably, the evaporator 118 is also configured to remove thermal energy from the dedicated fresh food compartment 102 to maintain the temperature therein at the desired target temperature (detailed above). That is, the dedicated fresh food compartment 102 and the convertible compartment 104 are associated with a common evaporator 118. Moreover, it is to be understood that the fresh food compartment 102 and the convertible compartment 104 are supplied with respective airflows cooled by only a single evaporator (i.e., the common evaporator 118). Said differently, the fresh food compartment 102 and the convertible compartment 104 are not supplied with airflows cooled by multiple (i.e., separate) evaporators. With this said, the refrigerator 100 may include separate evaporates in addition to the evaporator 118. For example, a dedicated ice maker evaporator (not shown) may be disposed in the fresh food compartment 102 and configured to provide a cool airflow solely for an ice maker (not shown) disposed therein. However, it is to be understood that said ice maker evaporator is provided solely for the purpose of cooling air flowing through the ice maker, and does not provide any meaningful cooling benefit for the overall fresh food compartment 102. In sum, it is the common evaporator 118 and only said evaporator 118 that provides a cooling effect to each of the dedicated fresh food compartment 102 and the convertible compartment 104 to achieve/maintain those compartments at their respective target temperatures.

Figure 4:
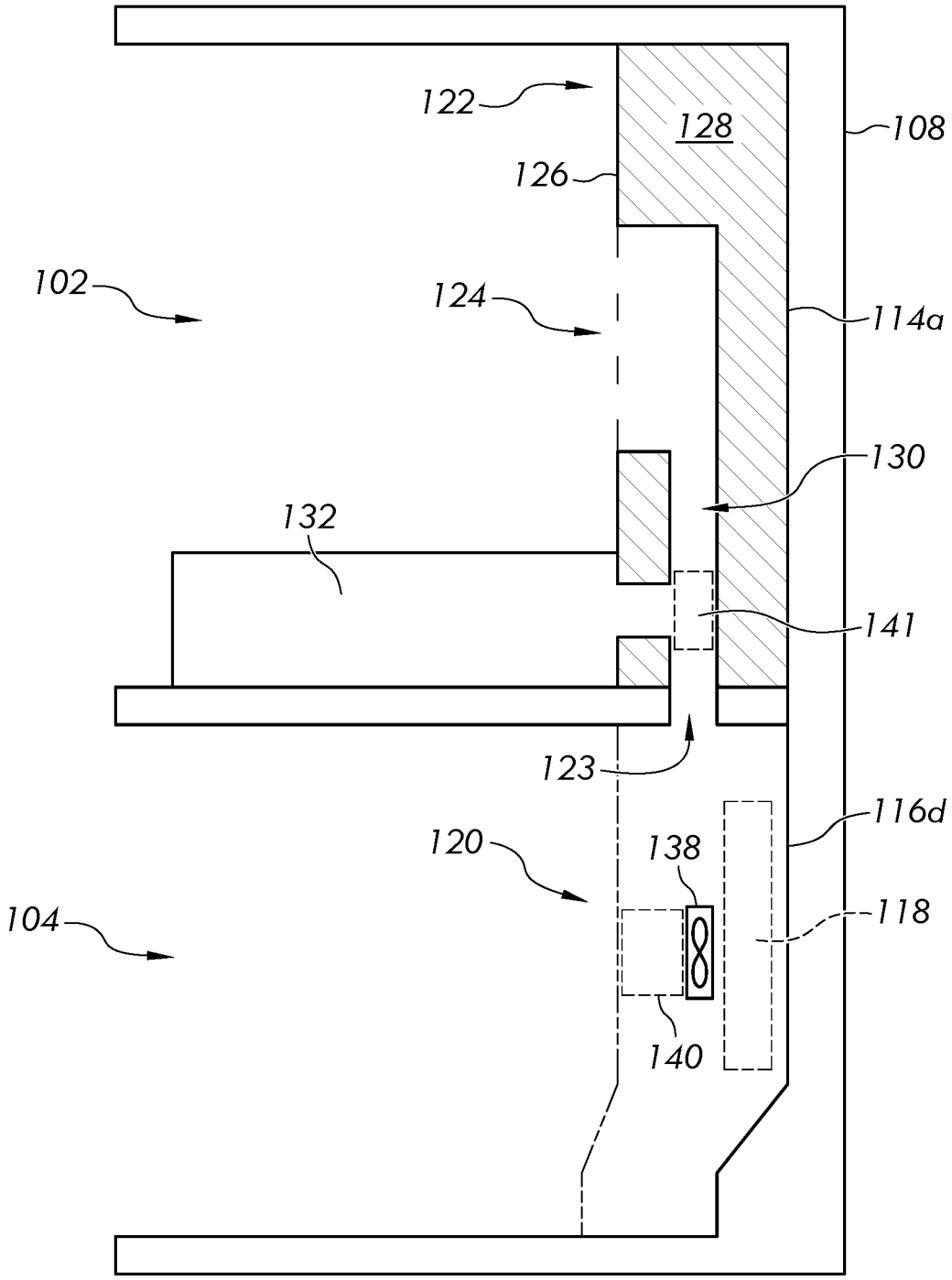
FIG. 4 is a schematic, cross-sectional view of the cooling device in FIG. 1.

Briefly moving back to FIG. 2, an air distributor assembly 120 is positioned within the convertible compartment 104 and is disposed adjacent the rear wall 116*d* of the convertible compartment liner 116 in covering relationship with respect to the evaporator 118. Accordingly, the evaporator 118 is disposed between the rear wall 116*d* of the convertible compartment liner 116 and the air distributor assembly 120 in a depth direction of the refrigerator 100 (e.g., as shown schematically in FIG. 4). Further, the air distributor assembly 120 extends laterally from one of the opposing sidewalls 116*c* of the convertible compartment liner 116 to the other, and extends vertically from the top wall 116*a* towards the bottom wall 116*b* of the convertible compartment liner 116. Notably, while FIG. 2 depicts a bottom-most edge of the air distributor assembly 120 being provided at a spaced distance (vertically) from the bottom wall 116*b*, it is to be understood that the air distributor assembly 120 can extend completely from the top wall 116*a* to the bottom wall 116*b*.

An air tower 122 is provided within the fresh food compartment 102 and is located adjacent a rear wall 114*a* (shown in FIG. 4) of the fresh food compartment liner 114. With respect to FIG. 4 (depicting a simple schematic of the refrigerator 100), the air tower 122 is in fluid communication with the air distributor assembly 120, via an air-pass 123 (e.g., aperture, through-hole, etc.) formed between the fresh food compartment liner 114 and the convertible compartment liner 116 (or a horizontal mullion, if present). The air tower 122 is configured to receive a cooled airflow (i.e., a second portion of airflow F2, discussed below) from the air distributor assembly 120 and exhaust said airflow into the fresh food compartment 102 via exhaust ports 124. Notably, the air tower 122 includes a false wall 126 and a duct body 128. The false wall 126 has the exhaust ports 124 formed therein and is disposed in front of the duct body 128 (in covering relationship thereto) and acts as a decorative false wall of the fresh food compartment 102. That is, while the fresh food compartment liner 114 includes the rear wall 114*a*, the false wall 126 of the air tower 122 is perceived by a user as the true rear wall of the fresh food compartment 102, as the duct body 128 and the rear wall 114*a* of the fresh food compartment liner 114 are covered thereby. The duct body 128 can be formed of EPS foam (or similar materials) and have a recessed pathway 130 (i.e., one or more cut-outs) formed therein. The recessed pathway 130 defines a flow path (i.e., a second flow path) that guides airflow therethrough.

As will be further discussed below, a temperature-controllable drawer 132 is optionally located within the fresh food compartment 102. The drawer 132 is likewise in fluid communication with the air distributor assembly 120 (via the air-pass 123 and/or the recessed pathway 130) such that the airflow from the air distributor assembly 120 is selectively received therein. Notably, the internal temperature of the drawer 132 is controllable independently of the fresh food compartment 102. That is, the internal temperature of the drawer 132 may be the same as or different from (i.e., greater than or less than) a set temperature of the fresh food compartment 102.

Notably, as will be discussed further below, a damper unit 141 (i.e., a second damper unit) is provided in the air tower 122. The damper unit 141 can be provided between the false wall 126 and the duct body 128 (e.g., partially embedded within the duct body 128), or fully embedded within the duct body 128. The damper unit 141 is configured to permit/prohibit airflow (i.e., the second portion of airflow F2) from entering into the fresh food compartment 102 and/or the temperature-controllable drawer 132 disposed therein. More specifically, with respect to FIG. 9, the damper unit 141 can be a dual-damper unit, having separate, first and second damper doors 175, 176 disposed within a common damper housing 177. In such a configuration, the first and second damper doors 175, 176 are independently controllable with respect to one another so as to selectively permit an airflow (i.e., the second portion of airflow F2) to enter into the fresh food compartment 102 and/or the temperature-controllable drawer 132. That is, the first damper door 175 selectively permits the airflow to enter into the fresh food compartment 102 while the second damper door 176 selectively permits the airflow to enter into the temperature-controllable drawer 132. Alternatively, it is contemplated that the damper unit 141 may include two, separately spaced housings (not shown), each having a corresponding damper door therein.

Figure 5:
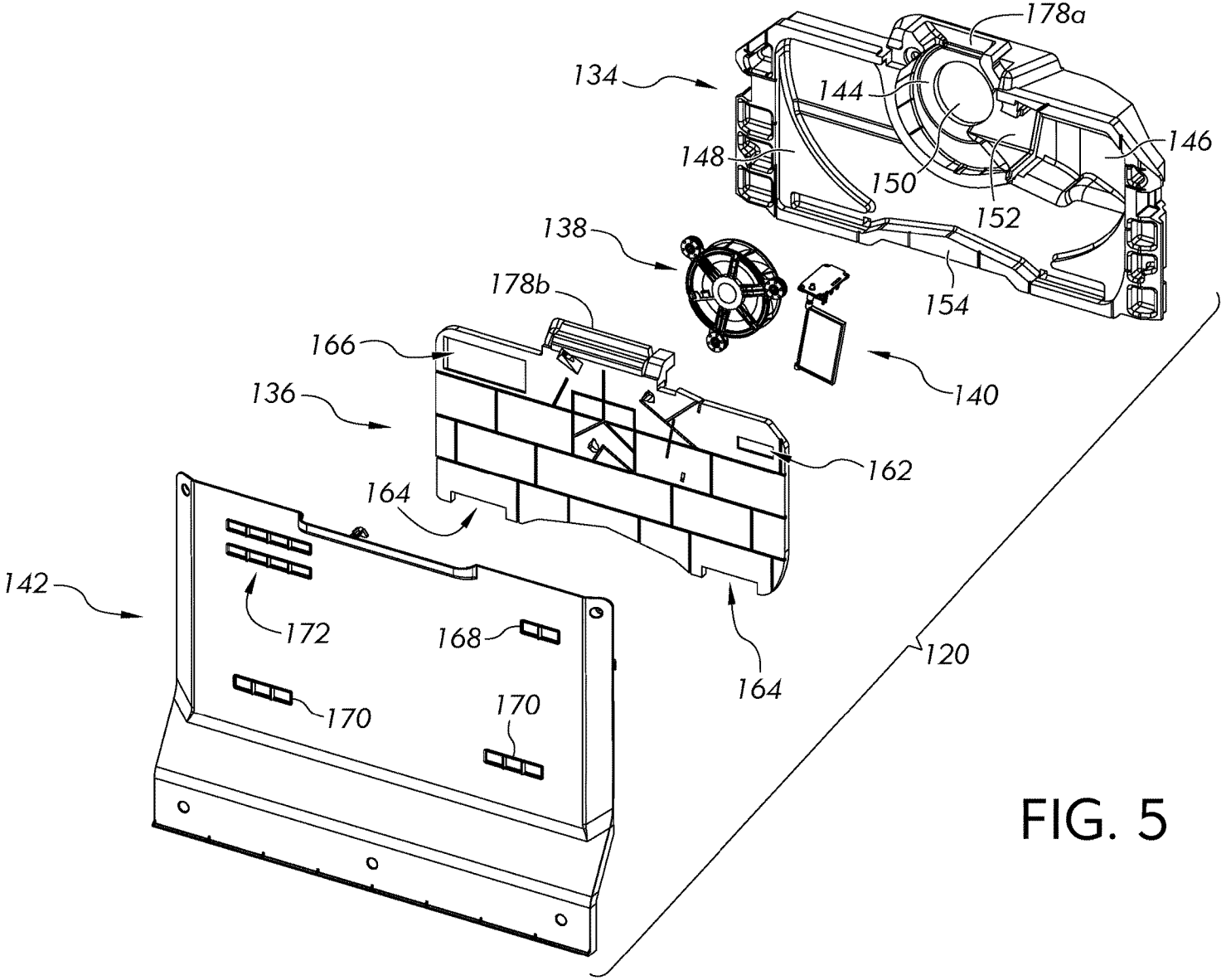
FIG. 5 is an exploded view of a first example of the air distributor assembly shown in FIG. 3.
Figure 6:
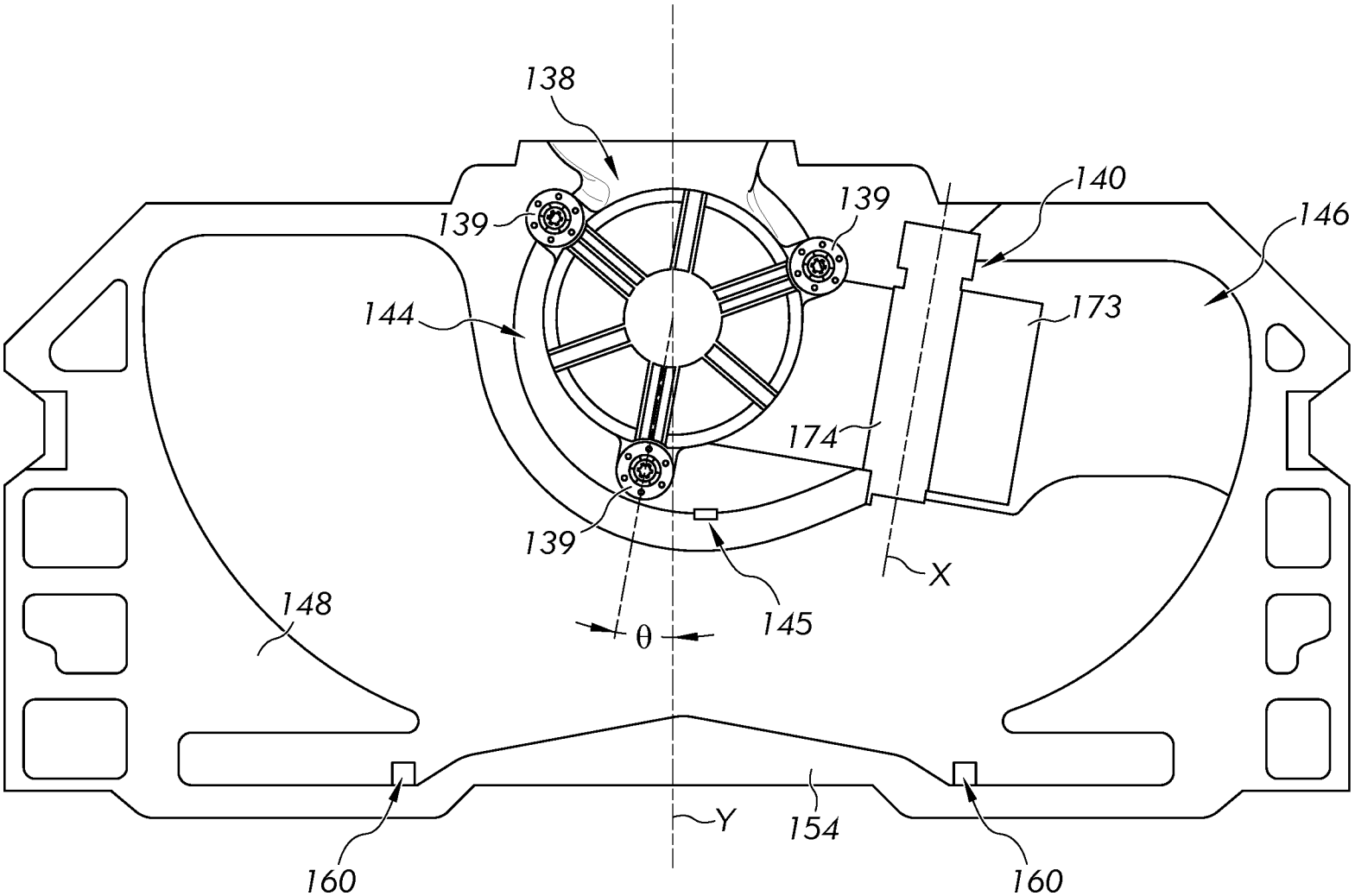
FIG. 6 is a front view of a body of the air distributor assembly shown in FIG. 5, including a fan and a damper unit installed therein.

Moving now to FIG. 5, an exploded view of the air distributor assembly 120 is shown. Specifically, the air distributor assembly 120 includes a body 134, a panel 136, a fan 138, a first damper unit 140, and a cover plate 142. The body 134 can be formed of an insulating material (e.g., EPS foam, etc.) and includes an air plenum 144 and a duct 146 recessed from a front surface 148 thereof (i.e., a surface facing the opening of convertible compartment 104, when installed therein). That is, the air plenum 144 and the duct 146 are formed as cut-outs in the body 134 with respect to the front surface 148. The air plenum 144 has a generally circular shape and is configured to receive the fan 138 therein, as will be further discussed below. Moreover, a drain hole 145 (i.e., an aperture or through-hole, best shown in FIGS. 6-7) is formed in the body 134 at the location of the air plenum 144 and is configured to permit draining of liquid condensate collected within the air plenum 144, as discussed further below. Notably, the drain hole 145 is located at a bottom portion of the air plenum 144. As further shown, a through-hole 150 is formed in the body 134 at a location of the air plenum 144. This through-hole 150 functions as an inlet for the fan 138, as explained below. Notably, the air plenum 144 and the duct 146 are separately defined within the body 134 via an intermediate damper seat 152 configured to receive the first damper unit 140 therein, as discussed further below.

Figure 7:
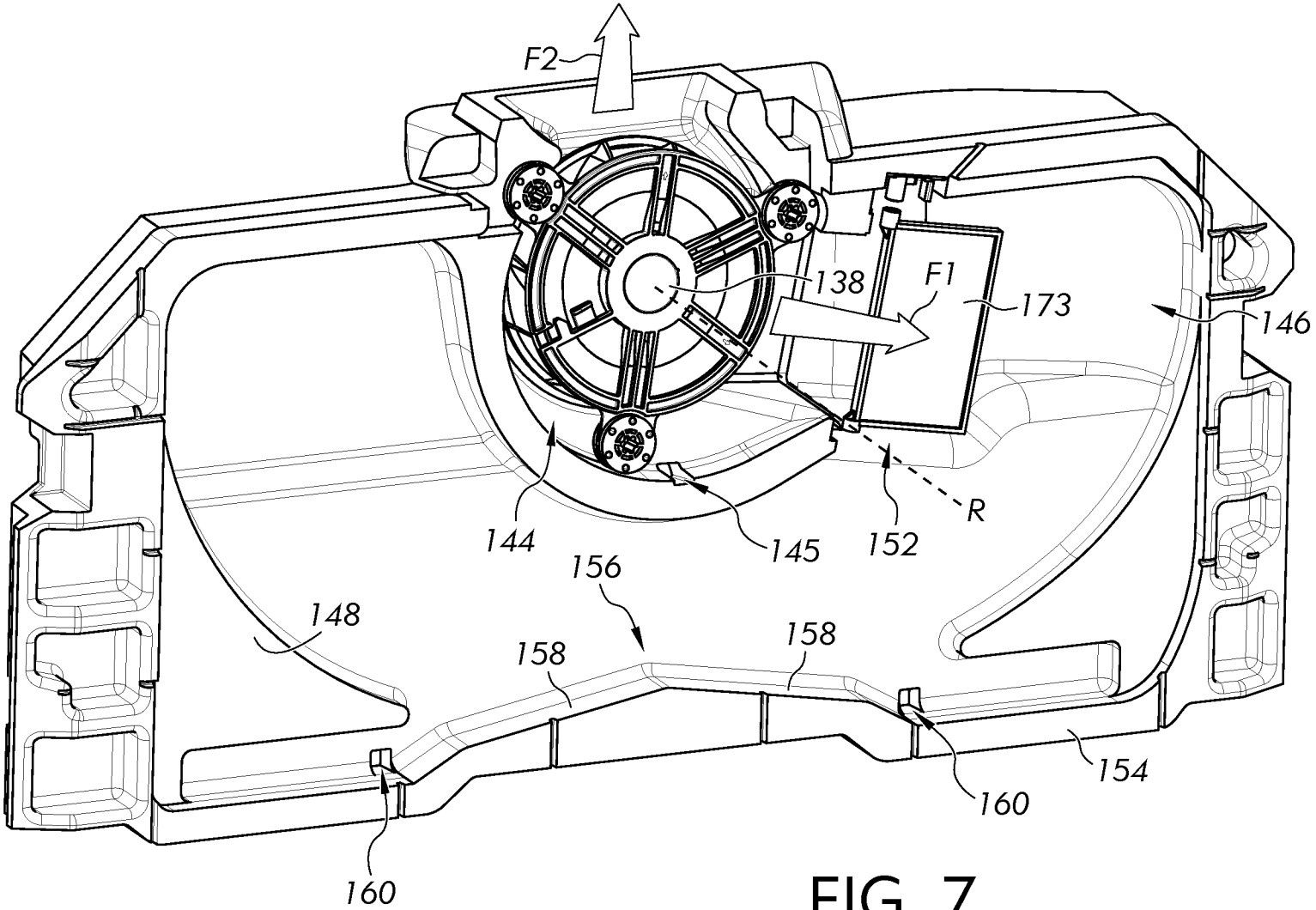
FIG. 7 is a perspective view of the body of the air distributor assembly shown in FIG. 6.

As further shown, a ridge 154 stands proud of the front surface 148 (i.e., protrudes outwards and away therefrom) and follows an outer perimeter of the body 134. As best shown in FIG. 7, a bottom end of the ridge 154 includes a peak 156 formed between adjacent, angled sections 158 thereof. Specifically, each angled section 158 is angled in opposite directions with respect to one another, such that each angled section 158 declines in a lateral direction away from said peak 156. Notably, each angled section 158 declines to a passage 160 (i.e., an aperture, through-hole, etc.) formed in the body 134. Similar to the drain hole 145 discussed above, the passages 160 are configured to permit draining of liquid condensate, guided thereto via the respective angled sections 158 of the ridge 154.

Moving back to FIG. 5, the panel 136 is generally a planar member made of insulation material (e.g., EPS foam). Notably, the panel 136 can be formed of a material that is the same as or different from the material of the body 134. The panel 136 includes a first cutout 162, a pair of second cutouts 164, and a third cutout 166. Notably, the first and third cutouts 162, 164 are depicted as completely defined through-holes formed in the panel 136 (i.e., an aperture being completely circumscribed by the panel 136), whereas the pair of second cutouts 164 are formed as partial through-holes (i.e., an aperture not completely circumscribed by the panel 136). It is to be understood that any of the first, second, and/or third cutouts 162, 164, 166 may be formed as a completely defined through-hole, or as a partial through-hole.

The first cutout 162 is located adjacent an upper corner of the panel 136 and, as will be discussed further below, is associated with a portion of a flow path (defined between the duct 146 and the panel 136) fluidly closest to the first damper unit 140. The third cutout 166 is located at an opposite, upper corner of the panel 136 and is associated with a portion of the flow path fluidly furthest from the first damper unit 140. Further, each of the pair of second cutouts 164 is located at a respective, lower corner of the panel 136 and is associated with a portion of the flow path fluidly between the first and third cutouts 162, 166.

Notably, the third cutout 166 is dimensioned so as to be greater than the first cutout 162. That is, an area of open space of the third cutout 166 is larger than an area of open space of the first cutout 162. As further shown, each of the second cutouts 164 has an area of open space that is equal to the other. Further still, the area of open space of either of the second cutouts 164 is greater than the area of open space of the first cutout 162, and is less than the area of open space of the third cutout 166. While the panel 136 is depicted as including a total of four cutouts (i.e., the first cutout 162, the pair of second cutouts 164, and the third cutout 166), it is to be understood that the panel 136 can have more than four cutouts, or even less than four cutouts.

Figure 8:
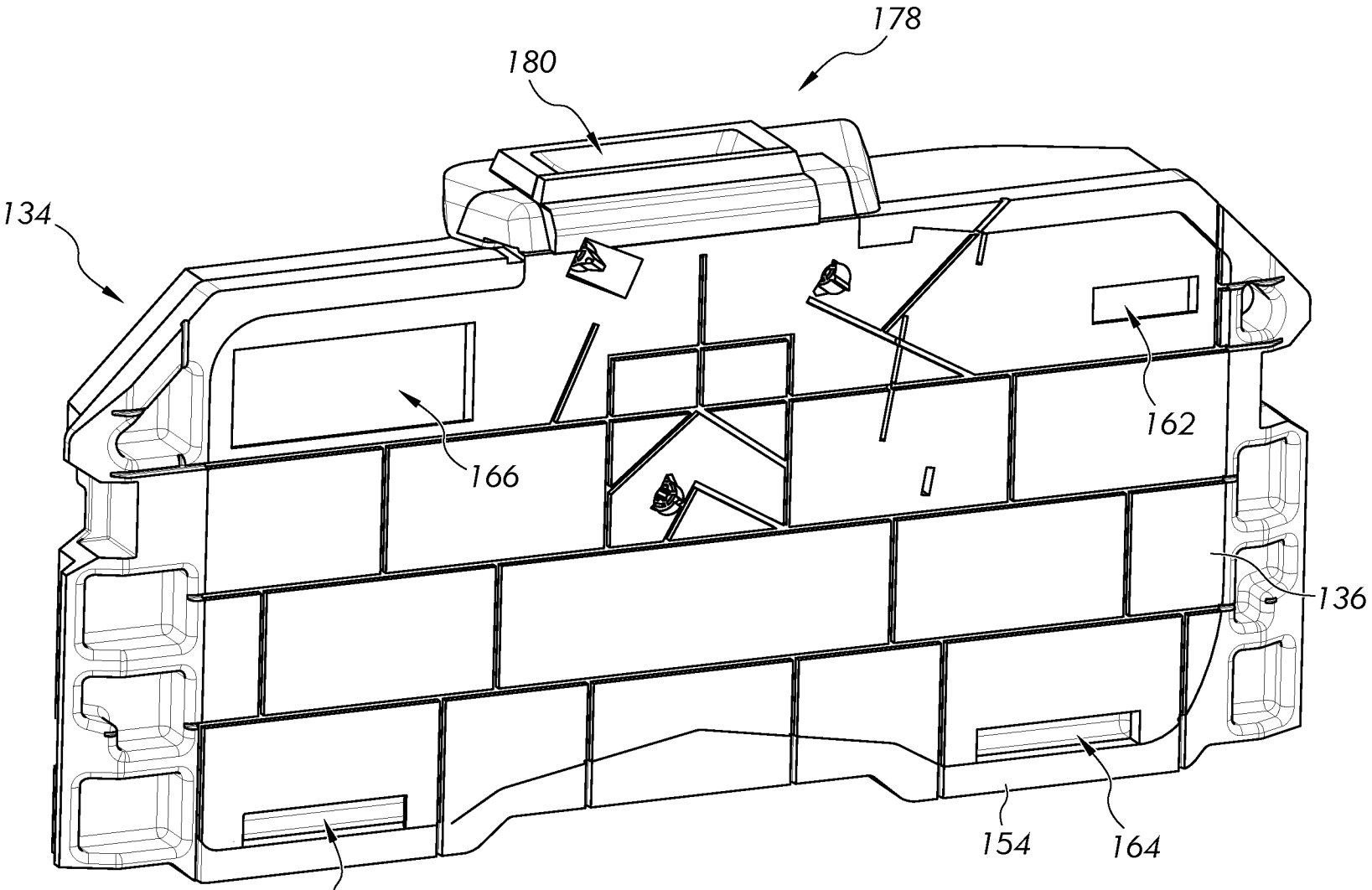
FIG. 8 is a perspective view of a panel of the air distributor assembly installed onto/within the body.

As will be discussed further below, the panel 136 is sized and shaped so as to be located adjacent the front surface 148 of the body 134 while the ridge 154 peripherally surrounds the panel 136. More specifically, in an assembled state (e.g., as shown in FIG. 8), the panel 136 rests on the front surface 148 of the body 134 and an inner peripheral surface of the ridge 154 circumscribes (i.e., surrounds) an outer peripheral edge of the panel 136.

As further shown in FIG. 5, the cover plate 142 is generally a plate-like member and acts as a decorative false wall of the convertible compartment 104. That is, while the convertible compartment liner 116 includes the rear wall 116*d* (shown in FIG. 3), the cover plate 142 of the air distributor assembly 120 is perceived by a user as the true rear wall of the convertible compartment 104, as the remaining elements of the air distributor assembly 120 and a majority of the rear wall 116*d* of the convertible compartment liner 116 are covered thereby. Notably, the cover plate 142 includes a plurality of outlets (e.g., through-holes, apertures, etc.) configured to permit discharge of an airflow (i.e., a first portion of airflow F1, discussed below) into the convertible compartment 104. More specifically, the cover plate 142 includes a first outlet 168, a pair of second outlets 170, and a third outlet 172.

Notably, when the air distributor assembly 120 is in the assembled state, the first outlet 168, the pair of second outlets 170, and the third outlet 172 are aligned with (i.e., axially overlap in the depth direction) the first cutout 162, the pair of second cutouts 164, and the third cutout 166 of the panel 136, respectively. Further, the dimensions of the first, second, and third outlet 168, 170, 172 can correspond to their associated (i.e., aligned) cutout 162, 164, 166. That is, an area of open space of the third outlet 172 is greater than an area of open space of the first outlet 168. Moreover, an area of open space of each of the second outlets 170 is greater than an area of open space of the first outlet 168, and is less than the area of open space of the third outlet 172. Notably, each of the first, second, and third outlets 168, 170, 172 of the cover plate 142 can be formed via a plurality of adjacently disposed apertures that are separate from one another (e.g., as shown in FIG. 5), or each of said outlets can be defined by a single aperture (e.g., as shown in FIG. 3).

Of note, in one example embodiment of the refrigerator 100, an optional ice maker (not shown) can be provided within the convertible compartment 104. The ice maker can be provided adjacent the cover plate 142 and aligned with the third outlet 172 formed therein. Accordingly, because the third outlet 172 has a larger open space than the other outlets, relatively more air can pass into the ice maker to accommodate the needed cooling therein. Further, an additional fan can be provided within the ice maker to further accommodate its cooling needs.

Finally, as noted above, the air distributor assembly 120 includes the fan 138 and the first damper unit 140. In the example embodiment discussed herein, the fan 138 is a centrifugal (i.e., radial) fan. However, it is to be understood that the fan 138 may be a different type of fan (e.g., axial fan, etc.). The fan 138 includes a housing having mounting points 139 (shown best in FIG. 6) provided at circumferentially spaced locations about an outer periphery thereof. As will be discussed further below, the mounting points 139 are configured to help secure the fan 138 within the body 134 (e.g., within the air plenum 144). Moreover, the first damper unit 140 includes a damper door 173 pivotably connected to a damper housing 174. As will be further discussed below, the damper door 173 is configured to pivot from an opened position to a closed position. In the opened position, the damper door 173 is moved out of the way so as not to prohibit airflow (e.g., air propelled by the fan 138) from entering into the duct 146. In the closed position, the damper door 173 is positioned to prohibit/hinder the airflow from entering the duct 146. Optionally, the damper door 173 is movable to any discrete position between the opened and closed positions, so as to permit adjustment of an amount of airflow entering into the duct 146. Moreover, the first damper unit 140 can include a heating function (e.g., heating coils, etc.) to increase its temperature to melt frozen condensate, or to prevent the freezing of liquid condensate.

Notably, in the assembled state, the air distributor assembly 120 includes a neck 178 having an aperture 180 defined therein (as shown in FIG. 8). The neck 178 projects outwards from the body 134 and is configured to guide (via the aperture 180) an airflow (i.e., the second portion of airflow F2) from the air plenum 144 to the air-pass 123 and/or the pathway 130 defined in the duct body 128 of the air tower 122. With respect to FIG. 5, the neck 178 is collectively defined by separate, first and second sections 178*a*, 178*b* formed on the body 134 and the panel 136, respectively. The first and second sections 178*a*, 178*b* of the neck 178 can be formed integral with the body 134 and the panel 136, respectively. Alternatively, the first and/or second section 178*a*, 178*b* can be formed separate and distinct from the body 134 and the panel 136, respectively, and subsequently secured thereto.

Assembly of the air distributor assembly 120 and installation into the convertible compartment 104 will now be discussed. Of note, it is to be understood that the below steps need not occur in the recited order. Moreover, it is contemplated that the total number of steps may be more or less than the those discussed herein. First, with respect to FIGS. 6-7, the fan 138 is installed within the air plenum 144 of the body 134. In particular, the fan 138 is arranged at a center point of the air plenum 144 such that the through-hole 150 (shown in FIG. 5) is in alignment with the air intake of the fan 138.

Often, but not always, this locates the through-hole 150 to be coaxial with a rotational axis 'R' of the fan 138 (shown in FIG. 7). Moreover, the fan 138 can be secured to the air plenum 144 via engaging conventional fasteners (e.g., screws, clips, etc.) with the mounting points 139 of the fan 138. Preferably, in the assembled state, a bottom-most mounting point 139 is offset from a vertical axis 'Y' (i.e., an axis extending in the top-bottom direction of the refrigerator 100 and intersecting with the rotational axis 'R'). In other words, the bottom-most mounting point 139 extends from the rotational axis 'R' at an angle θ (e.g., 5°-60°) with respect to the vertical axis 'Y.' This configuration hinders liquid condensate from freezing at the bottom-most mounting point 139. That is, because the bottom-most mounting point 139 is offset from the vertical axis 'Y,' and spaced a distance apart from the drain hole 145, liquid condensate forming on the housing of the fan 138 can follow the contours thereof and merge at the bottom-most mounting point 139, wherein said liquid condensate will drip therefrom via gravity and pool within the air plenum 144. Further, because of the location of the drain hole 145, said pooled liquid condensate is guided out of the air plenum 144 (e.g., to a drain pan, not shown), thereby preventing freezing within the air distributor assembly 120.

Next, the first damper unit 140 is disposed on the damper seat 152 of the body 134 and secured thereto. Notably, in the installed position, the first damper unit 140 resides on a longitudinal axis that is not parallel with respect to the vertical axis 'Y.' That is, the first damper unit 140 is not longitudinally arranged in the up-down direction. Rather, the first damper unit 140 is angled downwardly with respect to the vertical axis 'Y,' to encourage water drainage (e.g., liquid condensate).

As briefly mentioned above, the air plenum 144 and the duct 146 are separately defined from one another via the damper seat 152 disposed therebetween. Accordingly, when the first damper unit 140 is installed on the damper seat 152, the first damper unit 140 selectively permits a first portion of airflow F1 (shown in FIG. 7) to flow from the air plenum 144 and into the duct 146, as discussed further below.

Now moving to FIG. 8, after the fan 138 and the first damper unit 140 are installed within the air plenum 144 and the damper seat 152, respectively, the panel 136 is secured to the body 134. Specifically, the panel 136 is disposed adjacent the body 134 and translated therein until a face of the panel 136 rests against the front surface 148 of the body 134. As mentioned above, when the panel 136 is correctly installed, the inner peripheral surface of the ridge 154 circumscribes (i.e., surrounds) the outer peripheral edge of the panel 136. Accordingly, the panel 136 is completely received within the body 134. Notably, the panel 136 may be secured to the body 134 via conventional fasteners (e.g., screws, adhesives, clips, tabs, etc.). Alternatively, the body 134 and the panel 136 can be dimensioned such that no fasteners are needed for sufficient securement therebetween. For example, the panel 136 can be secured to the body 134 via a friction fit therebetween. Moreover, as discussed further below, when the panel 136 is secured to the body 134, a flow path (i.e., a first flow path) is defined as the space between by the duct 146 and the panel 136. The flow path is configured to guide the first portion of airflow F1 from the air plenum 144 into the duct 146 and therefore into the convertible compartment 104 (via the first, second, and third cutouts 162, 164, 166, in the panel 136 and their corresponding, respective first, second, and third outlets 168, 170, 172, formed in the cover plate 142).

After the panel 136 is secured to the body 134, the body 134 is then disposed within the convertible compartment 104 and placed adjacent the rear wall 116*d* of the convertible compartment liner 116. As mentioned above, the air distributor assembly 120 is placed in covering relationship with respect to the evaporator 118. Accordingly, when installed, the body 134 is disposed directly adjacent the evaporator 118. Moreover, the body 134 is arranged such that the through-hole 150 is located directly adjacent the evaporator 118. As such, the evaporator 118, the through-hole 150 and the fan 138 are all (axially aligned) with respect to the rotational axis 'R' of the fan 138. Notably, the body 134 can be secured to the rear wall 116*d* of the convertible compartment liner 116 via conventional means (e.g., fasteners, adhesives, etc.). Finally, after the body 134 is located within the convertible compartment 104, the cover plate 142 is disposed within the convertible compartment 104 and placed adjacent the body 134 (i.e., in covering relationship with respect to the panel 136).

With respect to FIG. 9 (schematically depicting fluid flow within the refrigerator 100), operation of the above-noted air distributor assembly 120 will now be discussed. Initially, the fan 138 is operated to draw an airflow over the evaporator 118 and into the air plenum 144 (via the through-hole 150, shown in FIG. 5). Notably, the fan 138 may be configured to operate at a single speed (i.e., rotations per minute) for a predetermined period of time. Alternatively, the fan 138 may be configured to operate at different speeds for a period of time. In other words, an operational speed of the fan 138 may be adjustable so as to optimize airflow (and thus cooling) of the dedicated fresh food compartment 102 and the convertible compartment 104.

As the airflow is drawn over (i.e., passing through) the evaporator 118, the airflow is cooled via heat exchange therewith. The cooled airflow entering the air plenum 144 is then radially dispersed such that a first portion of said airflow F1 is directed towards the first flow path (i.e., the space between by the duct 146 and the panel 136). As mentioned above, the first damper unit 140 is fluidly disposed between the air plenum 144 and the first flow path. Accordingly, when the first damper unit 140 is in a first position (i.e., the damper door 173 being in the opened position), the first portion of said airflow F1 is permitted to flow into the first flow path. Further, when the first damper unit 140 is in a second position (i.e., the damper door 173 being in a closed position), the first portion of said airflow is hindered or prohibited from flowing into the first flow path.

When the first damper unit 140 is in the first position, the first portion of said airflow F1 traverses through the first flow path and is exhausted into the convertible compartment 104 via the first, second, and third cutouts 162, 164, 166, and their corresponding first, second, and third outlets 168, 170, 172 formed in the cover plate 142. The first portion of said airflow F1 passes through the convertible compartment 104 and is subsequently drawn back towards the evaporator 118 (via apertures in the air distributor assembly 120 or spacing between the air distributor assembly 120 and the rear wall 116*d* of the convertible compartment liner 116).

As mentioned above, the convertible compartment 104 is configured to function as either a fresh food compartment or a freezer compartment based on user selection. Accordingly, when a selection is made (e.g., via a user interface, etc.) a control unit 182 (schematically shown in FIG. 1) controls at least the first damper unit 140 to achieve the desired temperature therein (i.e., the temperature range associated with the fresh food compartment or the freezer compartment, discussed above). For example, when a user selects the convertible compartment 104 to function as a fresh food compartment, the first damper unit 140 is modulated (e.g., cycled between the open and closed positions) at a predetermined rate sufficient to maintain the temperature of the convertible compartment 104 between 0° C. and 10° C., more preferably between 0° C. and 5° C., and even more preferably between 0.25° C. and 4.5° C. Alternatively, when a user selects the convertible compartment to function as a freezer compartment, the first damper unit 140 is modulated at another predetermined rate sufficient to maintain the temperature of the convertible compartment 104 at 0° C. or less, preferably between 0° C. and −50° C., more preferably between 0° C. and −30° C., and even more preferably between 0° C. and −20° C.

While the cooled airflow within the air plenum 144 is being radially dispersed (i.e., via the fan 138), a second portion of said airflow F2 is directed towards a second flow path (i.e., the recessed pathway 130 within the air tower 122). As mentioned above, the second damper unit 141 is provided at or within the recessed pathway 130. More specifically, the first damper door 175 is located fluidly between the air plenum 144 and the dedicated fresh food compartment 102. Accordingly, when the first damper door 175 of the second damper unit 141 is in a first position (i.e., an opened position), the second portion of said airflow F2 is permitted to flow through the recessed pathway 130 of the air tower 122 and into the fresh food compartment 102 (e.g., via the exhaust ports 124 formed therein). Further, when the first damper door 175 of the second damper unit 141 is in a second position (i.e., a closed position), the second portion of said airflow F2 is hindered/prohibited from flowing through the recessed pathway 130 and into the fresh food compartment 102. As noted above, a temperature of the dedicated fresh food compartment 102 is intended to be maintained between 0° C. and 10° C., more preferably between 0° C. and 5° C., and even more preferably between 0.25° C. and 4.5° C. Accordingly, the first damper door 175 of the second damper unit 141 can be modulated (e.g., cycled between the opened and closed positions via the control unit 182) at yet another predetermined rate sufficient to maintain the temperature therein at a desired target temperature within the above-noted temperature range.

Similar to the first damper door 175 of the second damper unit 141, the second damper door 176 of the second damper unit 141 is located fluidly between the air plenum 144 and the temperature-controllable drawer 132. Accordingly, when the second damper door 176 of the second damper unit 141 is in a first position (i.e., an opened position), the second portion of said airflow F2 is permitted to flow through the recessed pathway 130 of the air tower 122 and into the temperature-controllable drawer 132. Further, when the second damper door 176 of the second damper unit 141 is in a second position (i.e., a closed position), the second portion of said airflow F2 is hindered/prohibited from flowing through the recessed pathway 130 and into the temperature-controllable drawer 132. Similar to operation of the first damper door 175 noted above, the second damper door 176 of the second damper unit 141 can be modulated at yet another predetermined rate sufficient to maintain the temperature within the temperature-controllable drawer 132 at a desired target temperature, selected by the user.

As mentioned above, the first and second damper units 140, 141 are operated independently with respect to one another. That is, the damper door 173 of the first damper unit 140, and the first and second damper doors 175, 176 of the second damper unit 141 are all operated independently of one another to achieve and/or maintain a desired temperature within their corresponding, downstream areas (i.e., the convertible compartment 104, the dedicated fresh food compartment 102, or the temperature-controllable drawer 132). Consequently, when a user requests that the convertible compartment 104 be configured as a freezer compartment, the first damper unit 140 is modulated (i.e., cycled) to permit an increased amount of airflow within the convertible compartment 104 to efficiently decrease the temperature therein (i.e., to the desired temperature range) irrespective of a set temperature of the dedicated fresh food compartment 102. For example, the first damper door 175 of the second damper unit 141 may remain in the closed position for a set period of time while the temperature within the convertible compartment 104 is decreased. Accordingly, the temperature within the dedicated fresh food compartment 102 is not affected by the airflow generated via the fan 138.

Notably, when a user requests that the configuration of the convertible compartment 104 be switched from a freezer compartment to a fresh food compartment, the damper door 173 of the first damper unit 140 can remain in the closed position for a set period of time. With the first damper unit 140 being in the closed position, cool air is not exhausted into the convertible compartment 104, and as such an internal temperature thereof can increase over time. Moreover, it is contemplated that other components of the refrigerator may be used to help increase the internal temperature of the convertible compartment 104 (i.e., to an acceptable range of a fresh food compartment). For example, a defrost heater 119 (e.g., as schematically depicted in FIGS. 9-10) may be coupled to or positioned adjacent to the evaporator 118 and used to defrost condensate frozen thereon. When a user requests that the convertible compartment 104 be configured as a fresh food compartment, the control unit 182 may stop operation of the cooling system (i.e., stopping the refrigerant compressor and/or the condenser fan) and can further operate (i.e., turn on) the defrost heater 119 to increase the temperature in the air within the surrounding area at a faster rate of change than would otherwise occur without the addition of the heat. That heated air can then be exhausted into the convertible compartment 104 in the manner discussed above. That is, the fan 138 can be operated to move the warm air into and throughout the convertible compartment 104. The damper 173 may be modulated between the open and closed positions, or could remain partially, if not completely, open to encourage the warm air circulation within the convertible compartment 104. When the defrost heater is operated to warm the air, it is preferable to close both of the first and second damper doors 175, 176 so as to reduce the transfer of warm air into the fresh food compartment 102 or the temperature-controllable drawer 132. Once the convertible compartment 104 has reached the desired fresh food temperature, the defrost heater 119 is turned off and the cooling system can restart operation (i.e., restart the refrigerant compressor and/or the condenser fan) to provide cooled air via the evaporator 118. The damper door 173 of the first damper unit 140 may still be cycled open and closed to permit some cooling air to circulate throughout the convertible compartment 104 over time to maintain the desired fresh food temperature. Lastly, the first and second damper doors 175, 176 may be re-opened to permit the transfer of cooled air into the fresh food compartment 102 or the temperature-controllable drawer 132, as needed.

Now moving on to FIG. 10, an alternative embodiment of the air distributor assembly 120 is schematically shown. It is to be understood that, unless otherwise noted, the refrigerator includes the same features and/or functions in the same manner as noted above with respect to the first embodiment. That is, only the elements and functions that differ with respect to the first embodiment will be discussed. Moreover, for simplicity, the same reference numerals are used to designate the same or similar parts, where applicable.

Figure 9:
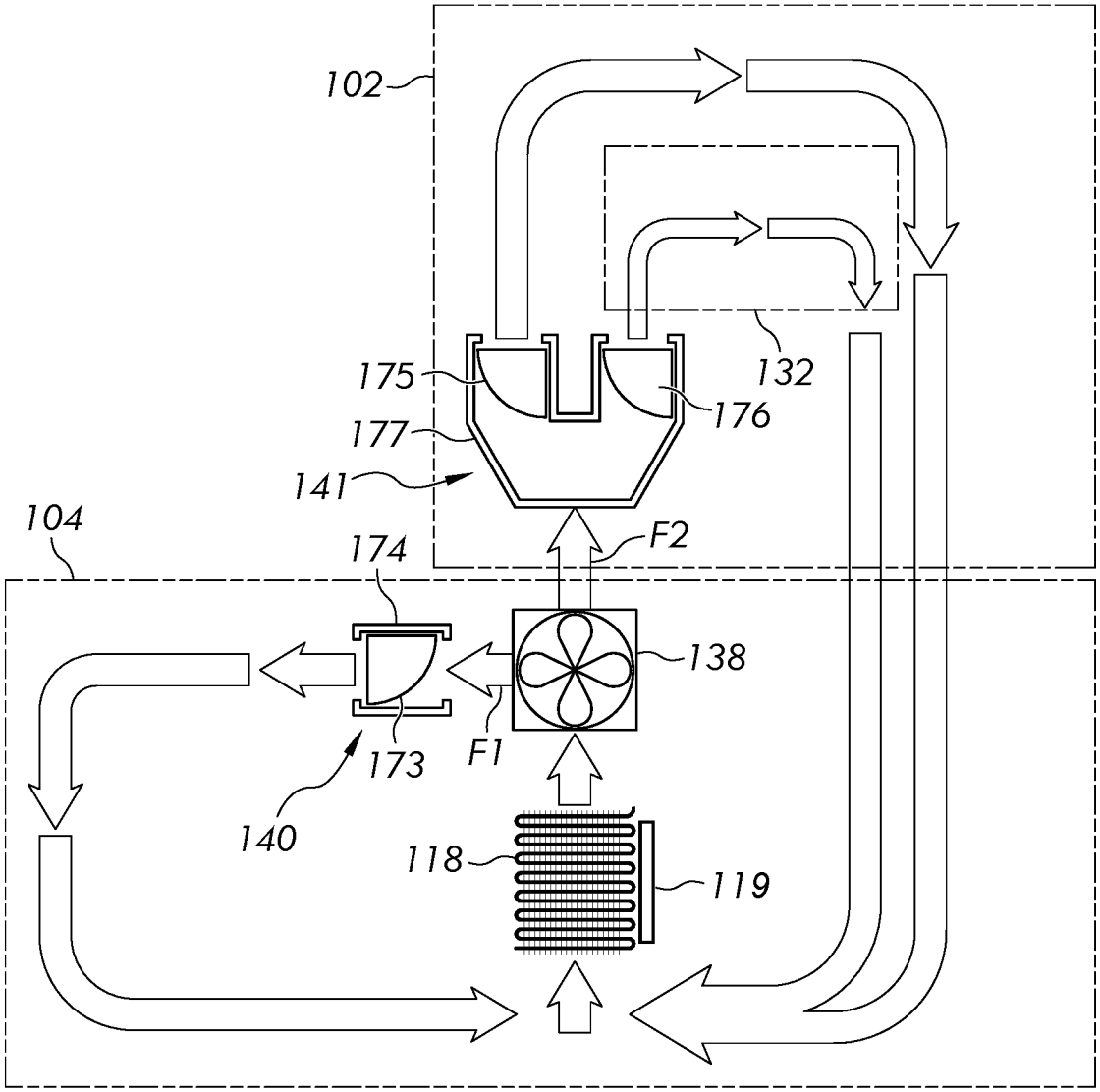
FIG. 9 is a schematic depiction of fluid flow within the cooling device according to the first example of the air distributor assembly.
Figure 10:
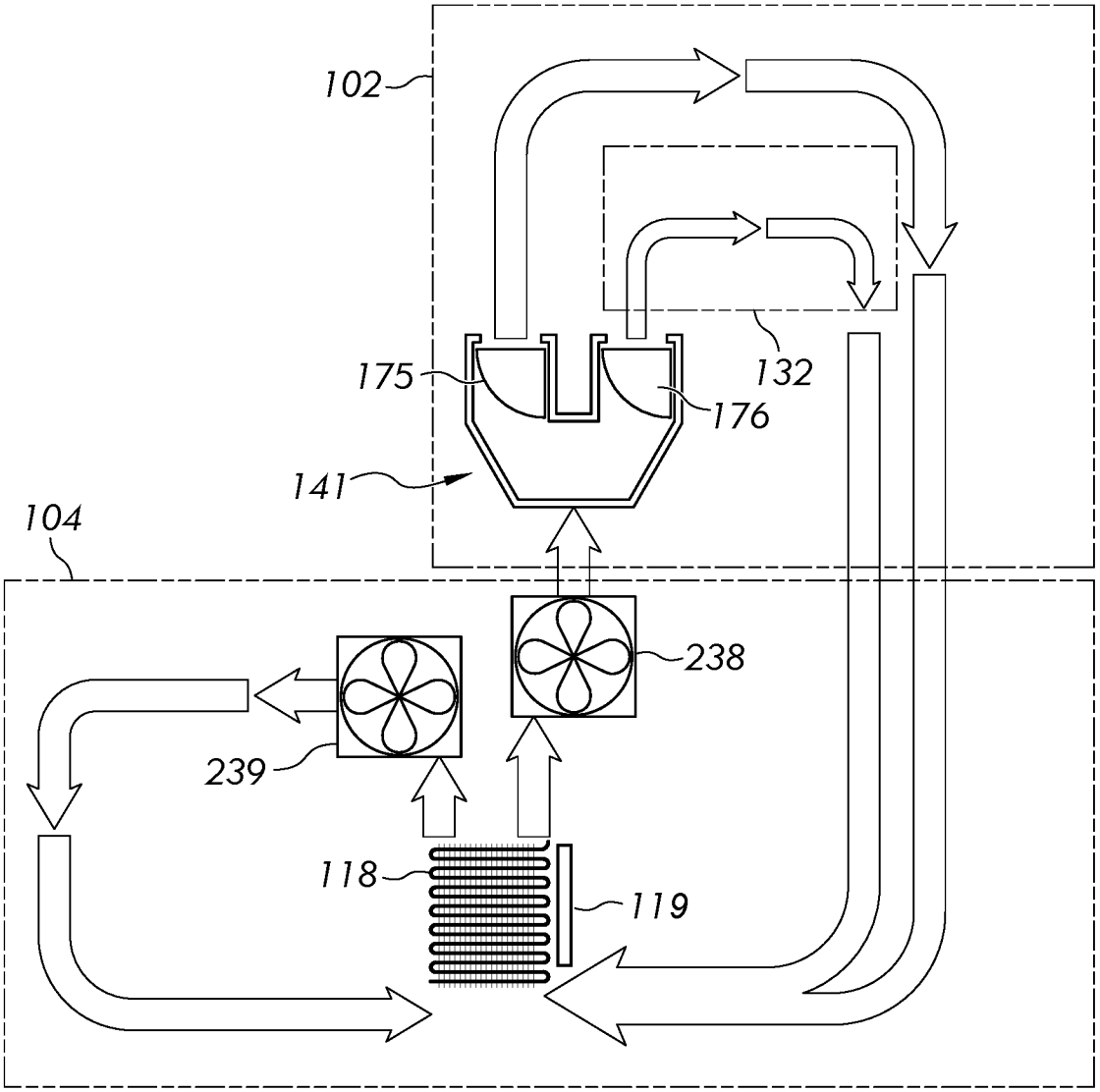
FIG. 10 is a schematic depiction of fluid flow within the cooling device according to a second example of the air distributor assembly.

In the second embodiment, the air distributor assembly 120 no longer includes a damper unit (i.e., the first damper unit 140 as schematically shown in FIG. 9) for the convertible compartment. Rather, the air distributor assembly 120 includes separate first and second fans 238, 239 housed therein. For example, each of the first and second fans 238, 239 can be a centrifugal fan (i.e., the same as the fan 138 of the first embodiment) and mounted to the body 134 in a similar manner to the fan 138 discussed above. For example, the body 134 may include a single air plenum 144 (e.g., as shown in FIG. 7) wherein both of said first and second fans 238, 239 are housed therein. Moreover, said first and second fans 238, 239 may be disposed adjacent respective first and second through-holes (each being similar to the through-hole 150 noted above and shown in FIG. 5) formed in the single air plenum so that each of said first and second fans 238, 239 is configured to directly receive an airflow passing through the evaporator 118. Alternatively, the body 134 may include separate air plenums, each configured to receive a designated one of the first and second fans 238, 239. Moreover, the first and second fans 238, 239 can be different types of fans. For example, one of the fans can be a centrifugal fan and the other fan can be an axial fan.

In either scenario, the first and second fans 238, 239 are independently controlled so as to operate either simultaneously (i.e., both urging an airflow at a single point in time) or separately (i.e., only the first fan 238 or the second fan 239 urging an airflow at a single point in time). In operation, the first and second fans 238, 239 generate separate airflows to be received in the dedicated fresh food compartment 102 and the convertible compartment 104, respectively. That is, the first fan 238 generates an airflow similar to the second portion of airflow F2 shown in FIG. 9, and the second fan 239 generates an airflow similar to the first portion of airflow F1 shown in FIG. 9. If cooling is not desired in either of the fresh food compartment 102 and/or the convertible compartment 104, the respective fan is turned off. The first and second fans 238, 239 may be configured to operate at a single speed (i.e., rotations per minute) for a predetermined period of time. Alternatively, the first and second fans 238, 239 may be configured to operate at different speeds for a period of time. In other words, a respective operational speed of the first and second fans 238, 239 may be adjustable so as to independently optimize airflow (and thus cooling) of the dedicated fresh food compartment 102 and the convertible compartment 104. Lastly, when a user requests that the convertible compartment 104 be configured as a fresh food compartment, the control unit 182 may stop operation of the cooling system and further operate (i.e., turn on) the defrost heater 119 to increase the temperature in the air within the surrounding area. The second fan 239 can be operated to move the warm air into and throughout the convertible compartment 104. During this time, it is preferable to stop operation of the first fan 238 and to close both of the first and second damper doors 175, 176 so as to reduce the transfer of warm air into the fresh food compartment 102 or the temperature-controllable drawer 132. Once the convertible compartment 104 has reached the desired fresh food temperature, the defrost heater 119 is turned off and the cooling system can restart operation to provide cooled air via the evaporator 118. The second fan 239 is then used to permit some cooling air to circulate throughout the convertible compartment 104 over time to maintain the desired fresh food temperature. Further, the first fan 238 may be restarted to circulate cooled air via the first and second damper doors 175, 176 into the fresh food compartment 102 and the temperature-controllable drawer 132, respectively, as needed.

In sum, the above-described refrigerator 100 includes an upper, dedicated fresh food compartment 102, and a lower, convertible compartment 104, wherein both said fresh food and convertible compartments 102, 104 are supplied with respective airflows cooled by only a single, common evaporator 118. Accordingly, cost and complexity of the aforementioned refrigerator 100 is reduced with respect to conventional appliances including dual-evaporator or multi-evaporator systems. Moreover, a target temperature of the convertible compartment 104 is successfully achieved/maintained via operation of a fan 138 common to both the fresh food and convertible compartments 102, 104, and a first damper unit 140, or even solely just a fan 238 associated only with the convertible compartment 104.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. A cooling device comprising:

a first storage compartment;

a second storage compartment disposed adjacent to the first storage compartment;

an evaporator disposed adjacent a wall of the second storage compartment;

an air distributor assembly disposed within the second storage compartment such that the evaporator is positioned between the air distributor assembly and the wall, the air distributor assembly including an air plenum and a first flow path defined therein;

a fan positioned within the air plenum and configured to draw an airflow over the evaporator and into the air plenum; and a first damper disposed within the air distributor assembly and fluidly between the air plenum and the first flow path, the first damper being movable between a first position and a second position, wherein when the first damper is in the first position, a first portion of the airflow received in the air plenum is permitted to flow into the first flow path, and wherein when the first damper is in the second position, the first portion of the airflow is hindered from flowing into the first flow path.

2. The cooling device of claim 1, wherein the air distributor assembly comprises a body and a panel, wherein a duct is formed as a recess in a surface of the body, and wherein the panel is disposed adjacent the surface so as to cover the duct to define the first flow path.

3. The cooling device of claim 2, wherein the body and the panel are separate and distinct from one another.

4. The cooling device of claim 2, wherein the body and the panel are made from EPS foam.

5. The cooling device of claim 2, wherein the fan is a centrifugal fan, and wherein the body has a through-hole formed therein, the through-hole being coaxial with a rotational axis of the fan.

6. The cooling device of claim 2, wherein a drain hole is formed in the body and is located in the air plenum, the drain hole configured to permit draining of liquid condensate collected within the air plenum.

7. The cooling device of claim 2, the body comprising a ridge standing proud from said surface thereof, said ridge following an outer perimeter of the body, wherein an inner peripheral surface of the ridge circumscribes an outer peripheral edge of the panel.

8. The cooling device of claim 7, the ridge comprising a peak formed at a bottom portion thereof, said peak being disposed between adjacent, angled sections thereof, wherein said angled sections are angled in opposite directions with respect to one another such that each angled section declines in a lateral direction away from said peak, and wherein each angled section declines to a respective drain passage formed in the body that permits draining of liquid condensate.

9. The cooling device of claim 2, wherein the panel includes a first cutout and a second cutout formed therein, wherein the first cutout is provided fluidly closer to the first damper than the second cutout, and wherein the first cutout is smaller than the second cutout.

10. The cooling device of claim 9, the air distributor assembly further comprising a cover plate disposed adjacent to the panel, the cover plate having a first outlet and a second outlet formed therein, wherein the first outlet is aligned with the first cutout, and wherein the second outlet is aligned with the second cutout.

11. The cooling device of claim 10, further comprising an ice maker disposed within the second storage compartment, wherein the second outlet is aligned with the ice maker.

12. The cooling device of claim 1, further comprising an air tower disposed within the first storage compartment, the air tower defining a second flow path therein, wherein the second flow path is in fluid communication with the air plenum.

13. The cooling device of claim 12, wherein a second damper is provided in the second flow path and is configured to selectively permit or hinder a second portion of the airflow received in the air plenum to flow through the second flow path and into the first storage compartment.

14. The cooling device of claim 13, wherein only one said evaporator is provided to cool the airflow received in the air plenum.

15. The cooling device of claim 1, further comprising a defrost heater coupled to or positioned adjacent to the evaporator, wherein the defrost heater is configured to melt condensate frozen on the evaporator.

16. The cooling device of claim 15, wherein a temperature of the second storage compartment can be increased by operating the defrost heater to warm the airflow while operating the fan to draw the airflow over the evaporator and into the air plenum.

17. The cooling device of claim 16, further comprising an air tower disposed within the first storage compartment, the air tower defining a second flow path therein in fluid communication with the air plenum, and a second damper is provided in the second flow path to selectively permit or hinder a second portion of the airflow into the first storage compartment, wherein the second damper is closed to hinder the second portion of the airflow into the first storage compartment when the defrost heater is operating.

18. The cooling device of claim 1, wherein the first storage compartment is disposed vertically above the second storage compartment and is configured to function as a dedicated fresh food compartment, and wherein the second storage compartment is a convertible compartment capable of functioning as either a fresh food compartment or a freezer compartment based on user selection.

19. The cooling device of claim 18, wherein only said evaporator provides a cooling effect to each of the first and second storage compartments.

20. A cooling device comprising:

a dedicated fresh food compartment;

a convertible compartment disposed vertically below the dedicated fresh food compartment;

an evaporator common to said dedicated fresh food compartment and said convertible compartment, wherein only said evaporator provides a cooling effect to each of the dedicated fresh food compartment and the convertible compartment, and wherein the evaporator is disposed adjacent a rear wall of the convertible compartment;

an air distributor assembly disposed within the convertible compartment such that the evaporator is positioned between the air distributor assembly and the rear wall, the air distributor assembly comprises:

a body including an air plenum and a duct that is formed as a recess in a surface of the body;

a planar panel disposed adjacent the surface of the body so as to cover the duct to define a first flow path therein;

a fan positioned within the air plenum and configured to draw an airflow over the evaporator and into the air plenum;

a first damper disposed within the air distributor assembly and fluidly between the air plenum and the first flow path, the first damper being movable between a first position and a second position, wherein when the first damper is in the first position, a first portion of the airflow received in the air plenum is permitted to flow into the first flow path and into the convertible compartment, and wherein when the first damper is in the second position, the first portion of the airflow is hindered from flowing into the first flow path and into the convertible compartment;

an air tower disposed within the dedicated fresh food compartment, the air tower defining a second flow path therein, wherein the second flow path is in fluid communication with the air plenum; and a second damper provided in the second flow path, the second damper being configured to selectively permit or hinder a second portion of the airflow received in the air plenum to flow through the second flow path and into the dedicated fresh food compartment.

* * * * *